US005165356A

United States Patent [19]

Williams

[11] Patent Number: 5,165,356

[45] Date of Patent: Nov. 24, 1992

[54] MAGNETIC SHIP HULL PATCH

[75] Inventor: Willard E. Williams, Maryville, Tenn.

[73] Assignee: Phillip A. Steele, Greenback, Tenn.

[21] Appl. No.: 807,088

[22] Filed: Dec. 13, 1991

[51] Int. Cl.[5] ..... B63B 43/16

[52] U.S. Cl. ..... 114/229

[58] Field of Search ..... 114/221, 222, 68, 227, 114/229, 225; 220/230, 232; 405/12

[56] References Cited

U.S. PATENT DOCUMENTS

| | | | |
|---|---|---|---|
| 635,939 | 10/1899 | Mason | 114/229 |
| 770,078 | 9/1904 | Kruger | 114/229 |
| 932,720 | 8/1909 | Reinhardt | 114/229 |
| 1,122,047 | 12/1914 | Villiers | 114/229 |
| 3,540,404 | 11/1970 | Modrey | 114/229 |
| 4,161,155 | 7/1979 | Cloutier | 114/227 |
| 4,385,582 | 5/1983 | Fuerst | 114/227 |
| 4,953,491 | 9/1990 | Zaitoun | 114/229 |
| 5,036,786 | 8/1991 | Uri | 114/229 |
| 5,038,701 | 8/1991 | Riddell | 114/229 |

FOREIGN PATENT DOCUMENTS

| | | |
|---|---|---|
| 2511646 | 2/1983 | France . |
| 1055684 | 11/1983 | U.S.S.R. . |

*Primary Examiner*—Joseph F. Peters, Jr.

*Assistant Examiner*—Stephen P. Avila

*Attorney, Agent, or Firm*—Pitts & Brittian

[57] ABSTRACT

A magnetic ship hull patch (10) for temporarily sealing a breach in a ship hull (14) or other vessel wall by use of electromagnetivity. The magnetic ship hull patch (10) includes a rigid plate member (20) configured to substantially conform to the outer surface of the ship hull (12). A plurality of reinforcing members (24) is provided for strengthening the rigid member (20). At least one electrically operated magnet (30) is provided for selectively securing the rigid member (20) to the ship hull (24). At least one power cord (36) is provided for communication between a power source and each of the electrically operated magnets (30). A cushion (44) is provided for conforming a surface of the rigid member (30) to the shape of the ship hull (12) at the subject location of a breach (14). A seal (50) is provided for sealably engaging the magnetic ship hull patch (10) with the ship hull (12). A support (56) may be provided for the storage and simplified transport of the magnetic ship hull patch (10). At least one support cable (64) and associated take-up reel (60) is provided for the raising and lowering of the magnetic ship hull patch (10). A take-up reel (62) may be provided for the lead wire (36) associated with the power source.

14 Claims, 3 Drawing Sheets

MAGNETIC SHIP HULL PATCH

DESCRIPTION

1. Technical Field

This invention relates to the field of ship hull repair. Specifically, this invention relates to the temporary repair of ship hulls through the use of electromagnetivity.

2. Background Art

In the field of marine vessels, it is well known that leaks may occur in the hull of the vessel, thereby allowing water to enter the boat, while allowing cargo to evacuate. In marine vessels such as oil tankers, damages are not limited to the value of the lost cargo, but have much deeper consequences. For example, costly and time-consuming clean-up is required. Large oil spills are also severely detrimental to the environment, with damage which may take years to repair.

For these reasons, it is imperative in the field of marine vessels that immediate repair of fractures in the hull of a vessel be made in an attempt to mitigate damages. Attempts have been made to forego accidents such as those created by fractured hulls. These efforts include a double hull for providing a means whereby a leak on the interior hull will be limited to the volume between the interior and exterior hulls, and likewise with a leak in the exterior hull. However, a leak in both the interior and exterior hulls simultaneously will render the hull arrangement useless. Further, the double-hulled ship is costly and difficult, if not impractical to retrofit.

Other devices have been produced to temporarily patch breaches in ship hulls. Typical of the art are those devices disclosed in U.S. Pat. Nos. 4,161,155 issued to C. C. Cloutier on Jul. 17, 1979 and 4,385,582 issued to E. J. Fuerst on May 31, 1983. These devices disclose inflatable members being mechanically held in position over the breach of the ship hull. However, inflatable bladders are difficult to place, especially under water where the tendency is to float to the surface. Further, inflatable members are susceptible to puncture, thereby negating any benefit otherwise acquired.

Other devices such as those disclosed in U.S. Pat. No. 4,953,491 issued to H. Zaitoun on Sept. 4, 1990; Soviet Pat. No. 1,055,684, issued on Nov. 23, 1983; and French Pat. No. 2,51,646 issued to Y. M. Mongodin incorporate rigid members held mechanically in place over a breach in a ship hull. However, devices such as these do not provide a secure seal of the breach for an extended period of time. Further, such devices are difficult to place. The Soviet and French patents, for example, are designed such that at least a portion of the patch apparatus is deployed from within the hull. Such deployment methods would be difficult in instances where the breach occurs within a crude oil reservoir.

Therefore, it is an object of this invention to provide a means for temporarily patching a breach in a ship hull with greater efficiency than provided for in the prior art of record.

It is also an object of the present invention is to provide a means whereby the patch apparatus may be easily positioned over a breach without necessitating access of the breach from within the vessel.

Another object of the present invention is to provide a ship hull patch which may be held in place electromagnetically for a strong seal between the ship hull patch and the ship hull, thereby substantially eliminating any leakage.

Still another object of the present invention is to provide an electromagnetically operated patch which may used in any application where a temporary, yet durable bond is required to seal an opening.

Disclosure of the Invention

Other objects and advantages will be accomplished by the present invention which serves to temporarily seal a breach in a ship hull or other vessel wall by use of electromagnetivity. Moreover, in the preferred embodiment, the magnetic ship hull patch is designed to be used to seal a breach in a vessel such as a pipeline or a barrel wherein an interior volume is to be isolated from the surrounding environment.

The magnetic ship hull patch is provided with a rigid plate member configured to substantially conform to the outer surface of the ship hull. The rigid member of the preferred embodiment is fabricated from a non-corrosive material such as stainless steel. A plurality of reinforcing members is provided for strengthening the rigid member, thus preventing undesired deflection of the rigid member due to the pressures exerted by water external to the ship hull and materials stored within. The reinforcing members serve to dissipate any load applied thereto over a larger area of the rigid member, thereby reducing the pressure exerted at the point of impact.

A biasing means is provided for selectively securing the rigid member to the ship hull. The biasing means includes at least one electromagnet. The preferred embodiment includes an electromagnet at each corner of the rigid plate, thereby providing securement at the extremities. An active surface of each electromagnet is defined by a first end of the electromagnet, with a power source being connected to a second end.

A power cord is provided for communication between a power source and each of the electromagnets, thereby activating the electromagnets. The power supply may be an AC supply or a DC supply, and will typically be pre-existing. The power cord is attached to each of the electromagnets, preferably proximate the second end. A single power supply may be used with the electromagnets being connected one to another with connecting wires and the power source being connected to one of the connecting wires at a junction by a lead wire.

A cushion is provided for conforming a surface of the rigid member to the shape of the ship hull at the subject location of a breach. In the preferred embodiment, the cushion is fabricated from a material such as foam and is dimensioned to be in contact with the rigid member over substantially an entire face of the rigid member. A face of the cushion is at least slightly farther from a face of the rigid member than is the active surface of the electromagnets and is configured to conform to the electromagnets such that substantially no gap is defined between the cushion and the electromagnets.

A seal is provided for sealably engaging the magnetic ship hull patch with the ship hull. The seal is attached to a face of the cushion opposite the rigid plate member for engaging the ship hull. The seal defines an area larger than that of the breach in the ship hull such that when the ship hull patch is engaged upon the breach, the breach is substantially sealed.

A support means may be provided for the storage and simplified transport of the magnetic ship hull patch. The support means includes a substantially linear member upon which a plurality of slidably engaged members is attached. Each of slidably engaged members is capable of moving along the substantially linear member and is connected to a support cable and associated take-up reel. The substantially linear member may be affixed to a ship in any conventional manner. The support cables are attached at one end to the magnetic ship hull patch proximate a top edge. The slidably engaged member may be moved along the substantially linear member and the support cables raised or lowered until the magnetic ship hull patch is appropriately positioned to substantially seal the breach. A take-up reel may be provided for the lead wire associated with the power source. The take-up reels provide for ease of storage of the support cables and the lead wire, respectively, or any length thereof which is unused.

The principles used in the design of the magnetic ship hull patch may be adapted for similar purposes such as temporarily patching a breach in a pipeline or an oil barrel. In such an instance, the rigid member would required a curved configuration to substantially conform to the circumference of the pipe. The thickness of the cushion and the height of the electromagnets is such that the profile of the ribs of a barrel will not substantially reduce the effectiveness of the seal.

BRIEF DESCRIPTION OF THE DRAWINGS

The above mentioned features of the invention will become more clearly understood from the following detailed description of the invention read together with the drawings in which.

Figure 1:
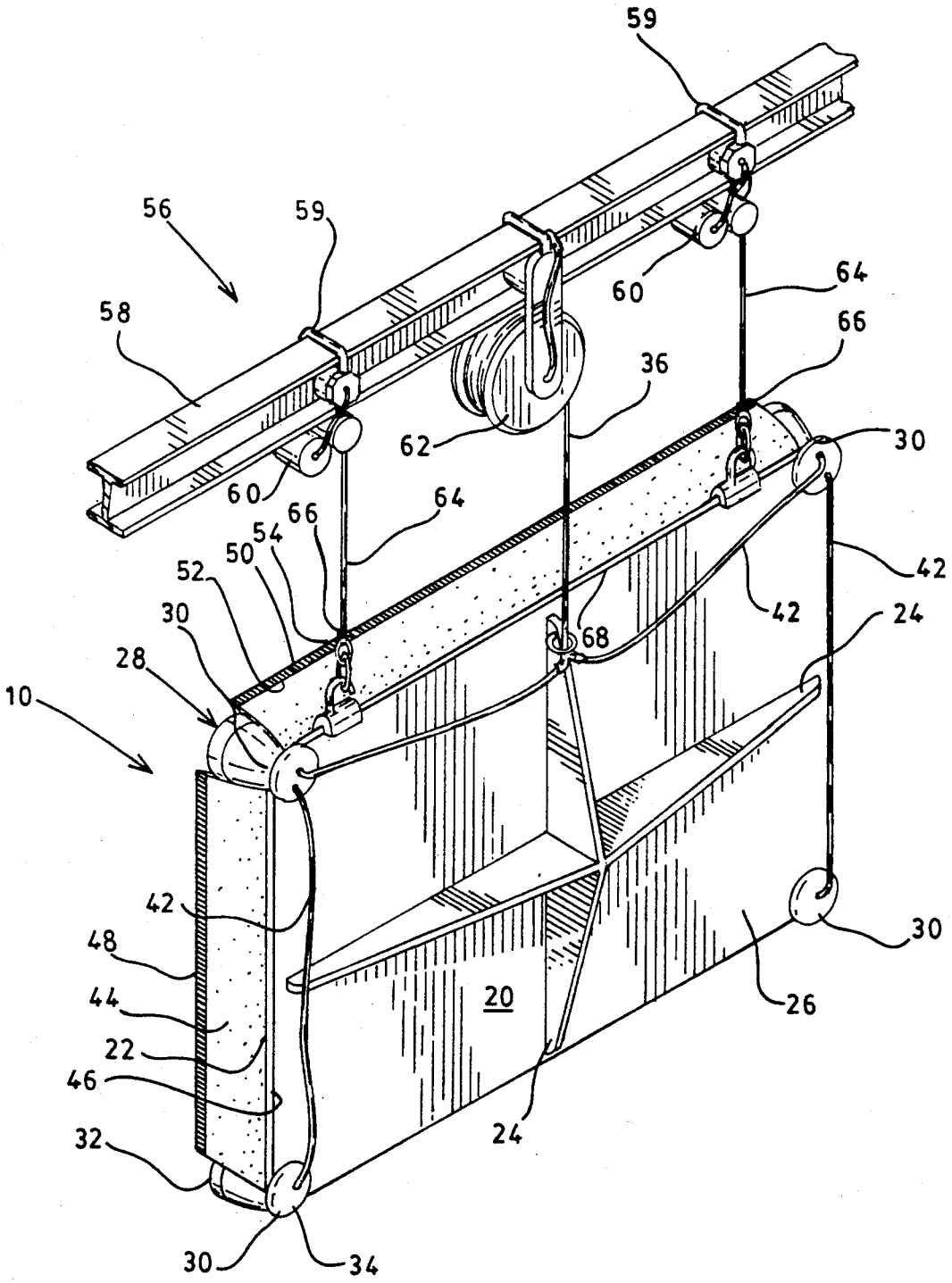
FIG. 1 is a perspective view of the magnetic ship hull patch constructed in accordance with several features of the present invention.

Best Mode for Carrvino out the Invention

A magnetic ship hull patch incorporating various features of the present invention is illustrated generally at 10 in the FIGURES. The magnetic ship hull patch 10 is designed for temporarily sealing breaches 14 in ship hulls 12 through incorporation of electromagnetivity. Moreover, in the preferred embodiment, the magnetic ship hull patch 10 is designed to be used to seal a breach 14 in a vessel such as a pipeline 16 or a barrel 18 wherein an interior volume is to be isolated from the surrounding environment.

Figure 2:
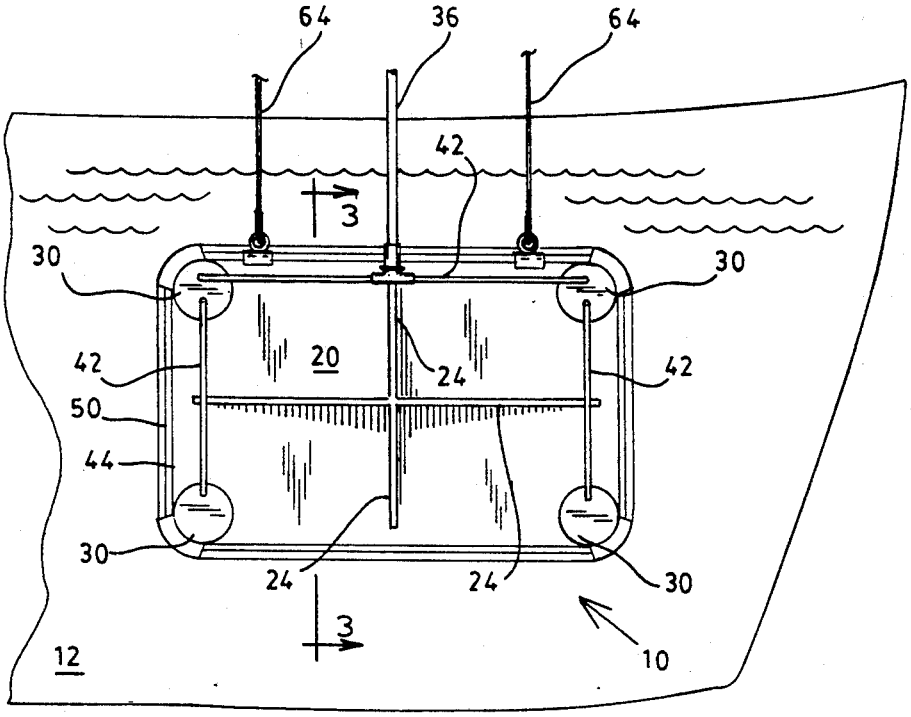
FIG. 2 illustrates a front elevation view of the magnetic ship hull patch of the present invention showing the attachment to a ship hull.
Figure 3:
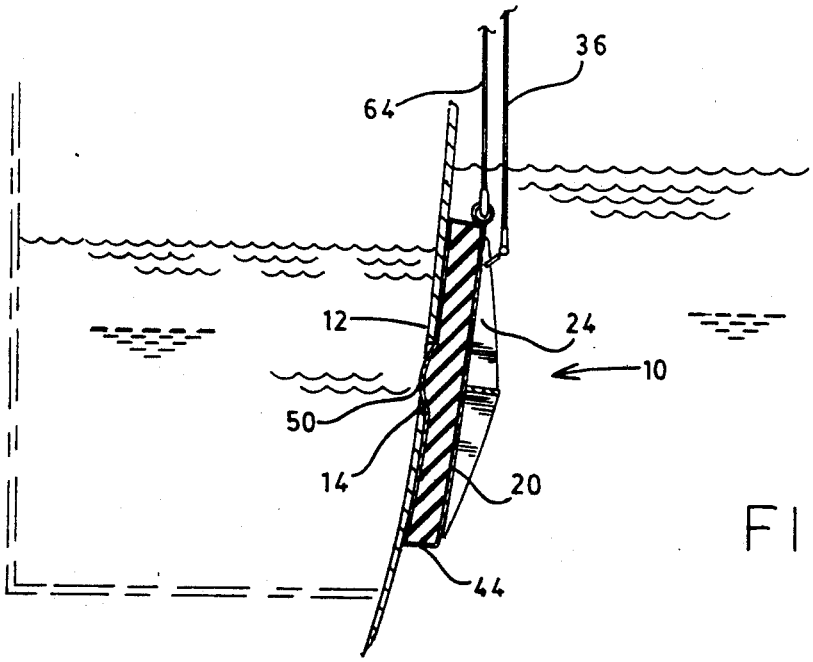
FIG. 3 is left side elevation view, in section taken at 3-3 of FIG. 2, of the ship hull patch of the present invention.
Figure 4:
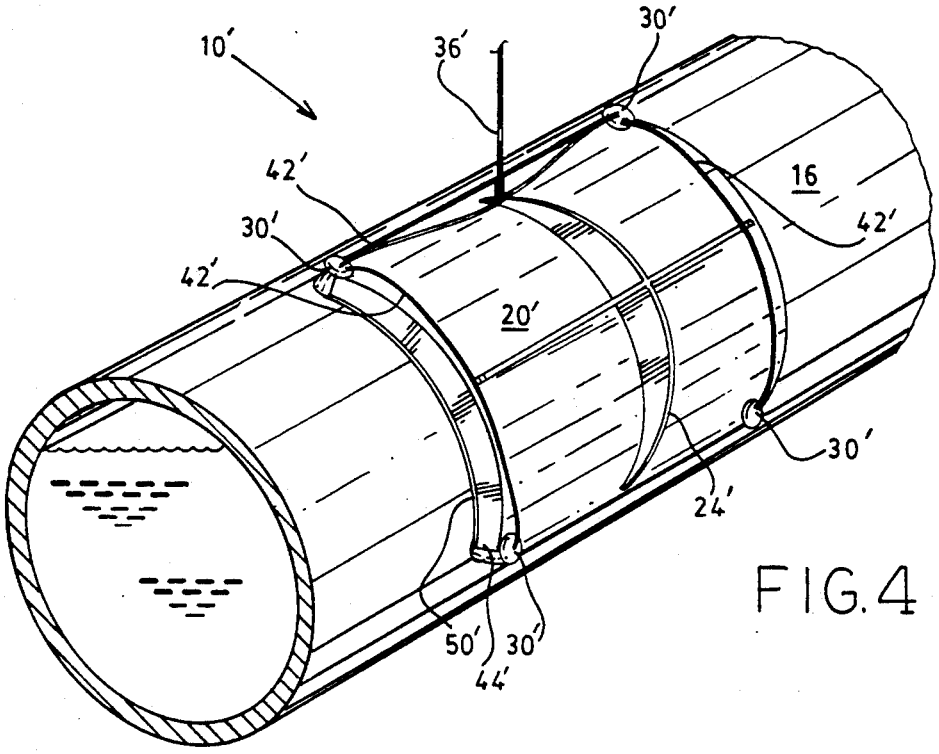
FIG. 4 is a perspective view of an alternate embodiment of the present invention being used to patch a circular pipe.
Figure 5:
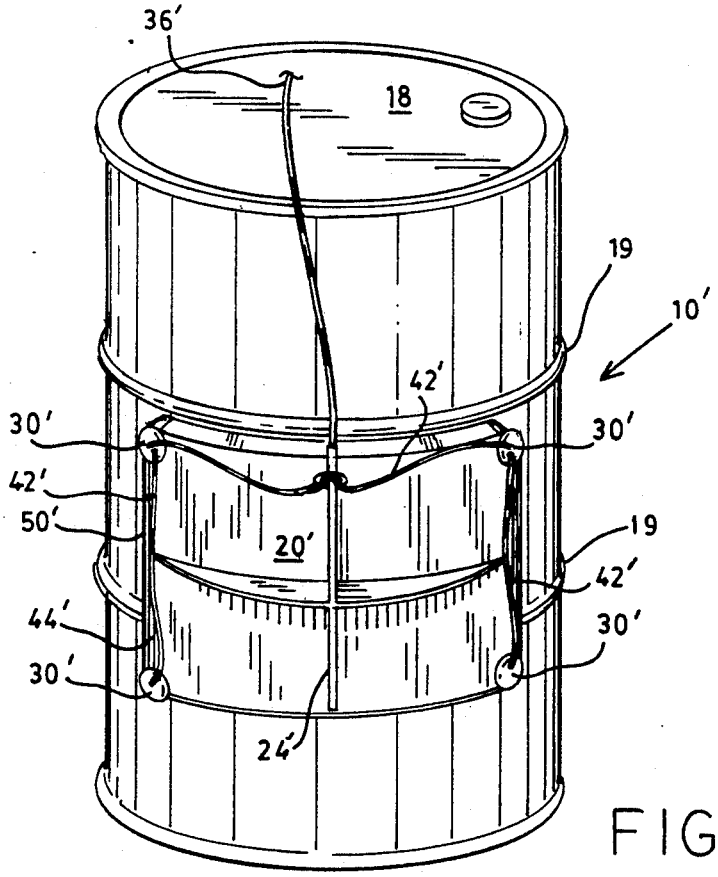
FIG. 5 is a perspective view of an alternate embodiment of the present invention being used to patch a standard barrel.

The magnetic ship hull patch 10 is provided with a rigid member 20 with a first face 22 configured to substantially conform to the outer surface of the ship hull 12. The rigid member 20 depicted in FIGS. 1-3 is substantially planar. As depicted in FIGS. 4 and 5, the rigid member 20', may define an arc to conform to a curved surface such as a pipeline 16 or a barrel 18. The rigid member 20 of the preferred embodiment is fabricated from a non-corrosive material such as stainless steel.

A plurality of reinforcing members 24 is provided for strengthening the rigid member 20, thus preventing undesired deflection of the rigid member 20 due to the pressures exerted by water external to the ship hull 12 and materials stored within. The reinforcing members 24 further aid in preventing damage to the rigid member 20 caused by impact of objects which may collide therewith. The reinforcing members 24 serve to dissipate any load applied thereto over a larger area of the rigid member 20, thereby reducing the pressure exerted at the point of impact. In the preferred embodiment, the reinforcing members 24 are carried by the rigid member 20 on the second face 26 thereof.

A biasing means 28 is provided for selectively securing the rigid member 20 to the ship hull 12. The biasing means 28 includes at least one electrically operated magnet 30, or electromagnet. As shown in the FIGURES, the preferred embodiment includes an electromagnet 30 at each corner of the rigid member 20, thereby providing securement at the extremities. An active surface 32 of each electromagnet 30 is positioned to engage the surface of a ship hull 12 such that the first face 22 of the rigid member 20 and the surface of the ship hull 12 are brought to close proximity. The active surface 32 of each electromagnet 30 is defined by a first end of the electromagnet 30, with a power source (not shown) being connected to a second end 34. Though a particular arrangement of electromagnets 30 is shown, it will be understood that any desired number and arrangement may be used depending upon the particular purpose.

A power cord 36 is provided for communication between a power source (not shown) and the electromagnets 30, thereby activating the electromagnets 30. The power supply may be an alternating current supply or a direct current supply, and will typically be preexisting. The power cord 36 is attached to each of the electromagnets 30, preferably proximate the second end 34. As shown in the FIGURES, a single power supply may be used with the electromagnets 30 being connected one to another other with connecting wires 42 and the power source being connected to one of the connecting wires 42 at a junction by a lead wire 36. It will be understood that each electromagnet 30 may be in communication with a separate power supply by a respective lead wire 36.

A cushion means 44 is provided for conforming the first face 22 of the rigid member 20 to the shape of the ship hull 12 at the subject location of a breach 14. The cushion means 44 defines first and second faces 46, 48, with the first face 46 being in contact with the first face 48 of the rigid member 20 and the second face 48 being held in close proximity to the ship hull 12. In the preferred embodiment, the cushion means 44 is fabricated from a material such as foam and is dimensioned to be in contact with the rigid member 20 as described over substantially the entire first face 22 of the rigid member 20. The cushion means 44 may be attached to the rigid member 20 in any conventional method suitable for submerging in liquids such as crude oil and salt water.

The cushion means 44 defines a thickness such that the second face 48 is at least slightly farther from the first face 22 of the rigid member 20 than is the active surface 32 of the electromagnets 30. The cushion means 44 is further dimensioned to conform to the dimensions of the electromagnets 30 such that substantially no gap is defined between the cushion means 44 and the respective electromagnets 30.

A sealing means 50 is provided for sealably engaging the magnetic ship hull patch 10 with the ship hull 12. The sealing means 50 defines a first face 52 dimensioned to substantially engage the second face 48 of the cushion means 44 and a second face 54 for engaging the ship hull 12. The sealing means 50 may be attached to the cushion means 44 in any conventional method suitable for submerging in liquids such as crude oil and salt water.

The preferred embodiment of the sealing means 50 defines an area larger than that of the breach 14 in the ship hull 12 such that when the magnetic ship hull patch 10 is engaged upon the breach 14, the breach 14 is substantially sealed. Preferably, the sealing means 50 is fabricated from a pliable, non-soluble material such as rubber.

Thus the magnetic ship hull patch 10 may be engaged upon the hull 12 of a ship proximate a breach 14 by electromagnetic forces for temporary yet durable sealing thereof. The magnetic ship hull patch 10 is placed over the breach 14 in such a manner that the sealing means 50 is in direct contact with the ship hull 12 proximate the sealing means second face 54 and substantially covers the breach 14. The power source is then energized, thus activating the electromagnets 30. The second face 48 of the cushion means 44 being farther from the rigid member 20 than the active surface 32 of the electromagnets 30, and thus the second face 48 of the cushion means 44 being still farther from the rigid member 20, the activation of the electromagnets 30 will draw the electromagnets 30, and thus the rigid member 20, toward the ship hull 12, thereby compacting the cushion means 44. As the cushion means 44 is compacted, the sealing means 50 is biased toward the ship hull 12 creating a positive seal around the breach 14 and thereby preventing further leakage into and out of the ship hull 12.

Increasing the power supplied by the power source will create a greater electromagnetivity and thereby a stronger seal. It will be seen, then, that the seal created by the magnetic ship hull patch 10 is dependant upon the power. Further, it will be seen that as long as power is delivered to the electromagnets 30, a seal will be maintained.

In the embodiment shown in FIG. 1, a support means 56 is provided for the storage and simplified transport of the magnetic ship hull patch 10. In this embodiment, the support means 56 includes a substantially linear member 58 upon which a plurality of slidably engaged members 59 is attached. Each of slidably engaged members 59 is capable of moving along the substantially linear member 58 and is connected to a support cable 64 and associated take-up reel 60. The substantially linear member 58 may be affixed to a ship in any conventional manner.

The support cables 64 are attached at one end 66 to the magnetic ship hull patch 10 proximate a top edge 68. Thus it will be seen that each slidably engaged member 59 may be moved along the substantially linear member 58 and the support cables 64 raised or lowered until the magnetic ship hull patch 10 is appropriately positioned to substantially seal the breach 14. It is envisioned that such placement may be electrically controlled, or it may be manually controlled as well.

In like manner to the take-up reels 60 for the support cables 64, a take-up reel 62 may be provided for the lead wire 36 associated with the power source. The take-up reels 60, 62 provide for ease of storage of the support cables 64 and the lead wire 36, respectively, or any length thereof which is unused.

As shown in FIG. 4, the principles used in the design of the magnetic ship hull patch 10 may be adapted for similar purposes such as a pipeline 16. In such an instance, the rigid member 20', would require a curved configuration to substantially conform to the circumference of the pipeline 16. All other elements required for the magnetic ship hull patch 10 would likewise be required for such purposes as a magnetic patch for a pipeline 10', and common elements are labelled with corresponding number as in the magnetic ship hull patch 10 followed by the ''''.

Further, FIG. 5 illustrates the use of such a magnetic patch 10– as described in FIG. 4 as being used to patch an oil barrel 18. In this embodiment, the thickness of the cushion means 44, and also the height of the electromagnets 30, is such that the profile of the ribs 19 of a barrel 18 will not substantially reduce the effectiveness of the seal.

From the foregoing description, it will be recognized by those skilled in the art that a magnetic ship hull patch offering advantages over the prior art has been provided. Specifically, the magnetic ship hull patch provides a means for temporarily sealing a breach in a ship hull or other vessel wall by use of electromagnetivity. Moreover, in the preferred embodiment, the magnetic ship hull patch is designed to be used to seal a breach in a vessel such as a pipeline or a barrel wherein an interior volume is to be isolated from the surrounding environment.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A magnetic ship hull patch for temporarily sealing a breach in a ship hull, said magnetic ship hull patch comprising:

a cover for substantially covering said breach in said ship hull;

a biasing member for selectively biasing said cover in a secured fashion toward said ship hull such that said breach is sealed, said biasing member including a plurality of electrically-operated magnets, each of said plurality of electrically-operated magnets defining an active surface for directly contacting said ship hull;

a power supply for delivering power from a power source to each of said electrically-operated magnets, said power supply including at least one electric cable;

a cushion for conforming a face of said cover to a profile defined by said ship hull proximate said breach, said cushion being attached to said face of said cover; and a seal for substantially sealing said breach upon selective engagement of said magnetic ship hull patch, said seal being attached to said cushion, said seal being positioned a distance farther from said cover relative to said active surface of each of said plurality of electrically-operated magnets.

2. The magnetic ship hull patch of claim 1 wherein said cushion is fabricated from a resilient pliable material.

3. The magnetic ship hull patch of claim 2 wherein said resilient pliable material is foam rubber.

4. The magnetic ship hull patch of claim 1 wherein said seal is fabricated from rubber.

5. The magnetic ship hull patch of claim 1 further comprising a reinforcing member for strengthening said cover.

6. A magnetic ship hull patch for temporarily sealing a breach in a ship hull, said magnetic ship hull patch comprising:

a cover for substantially covering said breach in said ship hull;

a reinforcing member for strengthening said cover;

a cushion for conforming a face of said cover to a profile defined by said ship hull proximate said breach, said cushion being attached to said face of said cover;

a seal for substantially sealing said breach upon selective engagement of said magnetic ship hull patch, said seal being attached to said cushion;

a biasing member for selectively biasing said cover in a secured fashion toward said ship hull such that said breach is sealed, said biasing member including a plurality of electrically-operated magnets, each of said plurality of electrically-operated magnets defining an active surface for directly contacting said ship hull, said active surface of each of said plurality of electrically operated magnets being positioned a distance nearer to said cover relative to said seal; and a power supply for delivering power from a power source to each of said plurality of electrically-operated magnets, said power supply including at least one electric cable.

7. The magnetic ship hull patch of claim 6 wherein said cushion is fabricated from foam rubber.

8. The magnetic ship hull patch of claim 6 wherein said seal is fabricated from rubber.

9. The magnetic ship hull patch of claim 6 further comprising a patch support for storage of said magnetic ship full patch and ease of positioning of said magnetic ship hull patch.

10. The magnetic ship hull patch of claim 9 wherein said patch support includes a substantially linear member for carrying a plurality of support cables, each of said plurality of support cables being engaged at one end of said cover, said support cables being traversable along said substantially linear member and retractable such that said magnetic ship hull patch may be positioned vertically and linearly along said ship hull for placement over said breach.

11. The magnetic ship hull patch of claim 6 wherein a collector is provided for collecting a slack portion of said electrical cable.

12. A magnetic patch for temporarily sealing a breach in a selected reservoir, said magnetic patch comprising:

a cover for substantially covering said breach in said selected reservoir;

a reinforcing member for strengthening said cover;

a cushion for conforming a face of said cover to a profile defined by said selected reservoir proximate said breach, said cushion being attached to said face of said cover;

a seal for substantially sealing said breach upon selective engagement of said magnetic patch, said seal being attached to said cushion;

a biasing member for selectively biasing said cover in a secured fashion toward said selected reservoir such that said breach is sealed, said biasing member including a plurality of electrically-operated magnets defining an active surface for directly contacting a wall of said selected reservoir, said active surface of each of said plurality of electrically-operated magnets being positioned a distance nearer to said cover relative to said seal; and a power supply for delivering power from a power source to each of said plurality of electrically-operated magnetics, said power supply including at least one electric cable.

13. The magnetic patch of claim 12 wherein said cushion is fabricated from foam rubber.

14. The magnetic patch of claim 12 wherein said seal is fabricated from rubber.

* * * * *